US008598796B2

(12) United States Patent
Jeong

(10) Patent No.: US 8,598,796 B2
(45) Date of Patent: Dec. 3, 2013

(54) LIGHT EMITTING DIODE DRIVER USING TURN-ON VOLTAGE OF LIGHT EMITTING DIODE

(76) Inventor: Jae Hong Jeong, Saratoga, CA (US)

( * ) Notice: Subject to any disclaimer, the term of this patent is extended or adjusted under 35 U.S.C. 154(b) by 178 days.

(21) Appl. No.: 13/316,734

(22) Filed: Dec. 12, 2011

(65) Prior Publication Data

US 2012/0146522 A1 Jun. 14, 2012

Related U.S. Application Data

(60) Provisional application No. 61/422,128, filed on Dec. 11, 2010.

(51) Int. Cl.
*H05B 37/00* (2006.01)

(52) U.S. Cl.
USPC ..... 315/192; 315/185 R

(58) Field of Classification Search
None
See application file for complete search history.

(56) References Cited

U.S. PATENT DOCUMENTS

| | | | | |
|---|---|---|---|---|
| 6,989,807 | B2 | 1/2006 | Chiang | |
| 7,081,722 | B1 * | 7/2006 | Huynh et al. | 315/323 |
| 7,439,944 | B2 | 10/2008 | Huynh et al. | |
| 8,080,819 | B2 * | 12/2011 | Mueller et al. | 257/13 |
| 2006/0175985 | A1 | 8/2006 | Huynh et al. | |
| 2006/0208669 | A1 | 9/2006 | Huynh et al. | |
| 2008/0001547 | A1 * | 1/2008 | Negru | 315/189 |
| 2008/0116817 | A1 | 5/2008 | Chao | |
| 2009/0128055 | A1 | 5/2009 | Shin et al. | |
| 2009/0187925 | A1 * | 7/2009 | Hu et al. | 719/327 |
| 2009/0273288 | A1 * | 11/2009 | Zhao et al. | 315/185 R |
| 2010/0146522 | A1 * | 6/2010 | Duffy | 719/318 |
| 2010/0194298 | A1 | 8/2010 | Kuwabara | |
| 2010/0308738 | A1 * | 12/2010 | Shteynberg et al. | 315/185 R |
| 2010/0308739 | A1 | 12/2010 | Shteynberg et al. | |
| 2011/0273102 | A1 | 11/2011 | Van De Ven et al. | |
| 2012/0081009 | A1 | 4/2012 | Shteynberg et al. | |

FOREIGN PATENT DOCUMENTS

| | | | |
|---|---|---|---|
| JP | 2007-123562 | A | 5/2007 |
| JP | 2007-173813 | A | 7/2007 |
| JP | 2010-225742 | A | 10/2010 |
| KR | 10-2008-0034316 | A | 4/2008 |
| KR | 10-2009-0050381 | A | 5/2009 |
| KR | 10-0905844 | B1 | 7/2009 |
| KR | 10-2010-0067468 | A | 6/2010 |
| KR | 10-0973014 | B1 | 7/2010 |
| KR | 10-0997050 | B1 | 11/2010 |
| WO | 2012-034102 | A1 | 3/2012 |
| WO | 2012-061999 | A1 | 5/2012 |

* cited by examiner

*Primary Examiner* — Crystal L Hammond
(74) *Attorney, Agent, or Firm* — Patent Office of Dr. Chung Park

(57) ABSTRACT

A driver circuit for driving light emitting diodes (LEDs). The driver circuit for driving light emitting diodes (LEDs) includes a string of LEDs divided into n groups. The n groups of LEDs are electrically connected to each other in series and the downstream end of group m−1 is electrically connected to the upstream end of group m, where m is a positive number equal to or less than n. The driver circuit also includes a plurality of current regulating circuits, where each of the current regulating circuits is coupled to a downstream end of a corresponding group and has at least one transistor and a detector for measuring a current flowing through the corresponding group.

22 Claims, 10 Drawing Sheets

LIGHT EMITTING DIODE DRIVER USING TURN-ON VOLTAGE OF LIGHT EMITTING DIODE

CROSS REFERENCES TO RELATED APPLICATIONS

This application claims the benefit of U.S. Provisional Applications No. 61/422,128, filed on Dec. 11, 2010, entitled "Light emitting diode driver using turn-on voltage of light emitting diode," and relates copending U.S. application Ser. No. 13/244,892, filed on Sep. 26, 2011, entitled "Light emitting diode driver," U.S. application Ser. No. 13/244,873, filed on Sep. 26, 2011, entitled "Light emitting diode driver having cascode structure," and U.S. application Ser. No. 13/244,900, filed on Sep. 26, 2011, entitled "Light emitting diode driver having phase control mechanism," which are hereby incorporated by reference in their entirety.

BACKGROUND OF THE INVENTION

The present invention relates to a light emitting diode (LED) driver, and more particularly, to a circuit for driving a string of light emitting diode (LEDs).

Due to the concept of low energy consumption, LED lamps are prevailing and considered a practice for lighting in the era of energy shortage. Typically, an LED lamp includes a string of LEDs to provide the needed light output. The string of LEDs can be arranged either in parallel or in series or a combination of both. Regardless of the arrangement type, providing correct voltage and/or current is essential to efficient operation of the LEDs.

In application where the power source is periodic, the LED driver should be able to convert the time varying voltage to the correct voltage and/or current level. Typically, the voltage conversion is performed by circuitry commonly known as AC/DC converters. These converters, which employ an inductor or transformer, capacitor, and/or other components, are large in size and have short life, which results in an undesirable form factor in lamp design, high manufacturing cost, and reduction in system reliability. Accordingly, there is a need for an LED driver that is reliable and has a small form factor to thereby reduce the manufacturing cost.

SUMMARY OF THE INVENTION

In one embodiment of the present disclosure, a driver circuit for driving light emitting diodes (LEDs) includes a string of LEDs divided into n groups, the n groups of LEDs being electrically connected to each other in series, the downstream end of group m−1 being electrically connected to the upstream end of group m, where m is a positive number equal to or less than n. The driver circuit also includes a plurality of current regulating circuits, where each of the current regulating circuits is coupled to a downstream end of a corresponding group and has at least one transistor and a detector for measuring a current flowing through the corresponding group.

In another embodiment of the present disclosure, a method for driving light emitting diodes (LEDs) includes: providing a string of LEDs divided into groups, the groups being electrically connected to each other in series; coupling each of the groups to a ground through a separate current regulating circuit; causing a detector of the separate current regulating circuit to measure a current flowing through a corresponding one of the groups; and controlling the current based on the measured current.

These and other features, aspects and advantages of the present invention will become better understood with reference to the following drawings, description and claims.

DETAILED DESCRIPTION OF THE INVENTION

Figure 1:
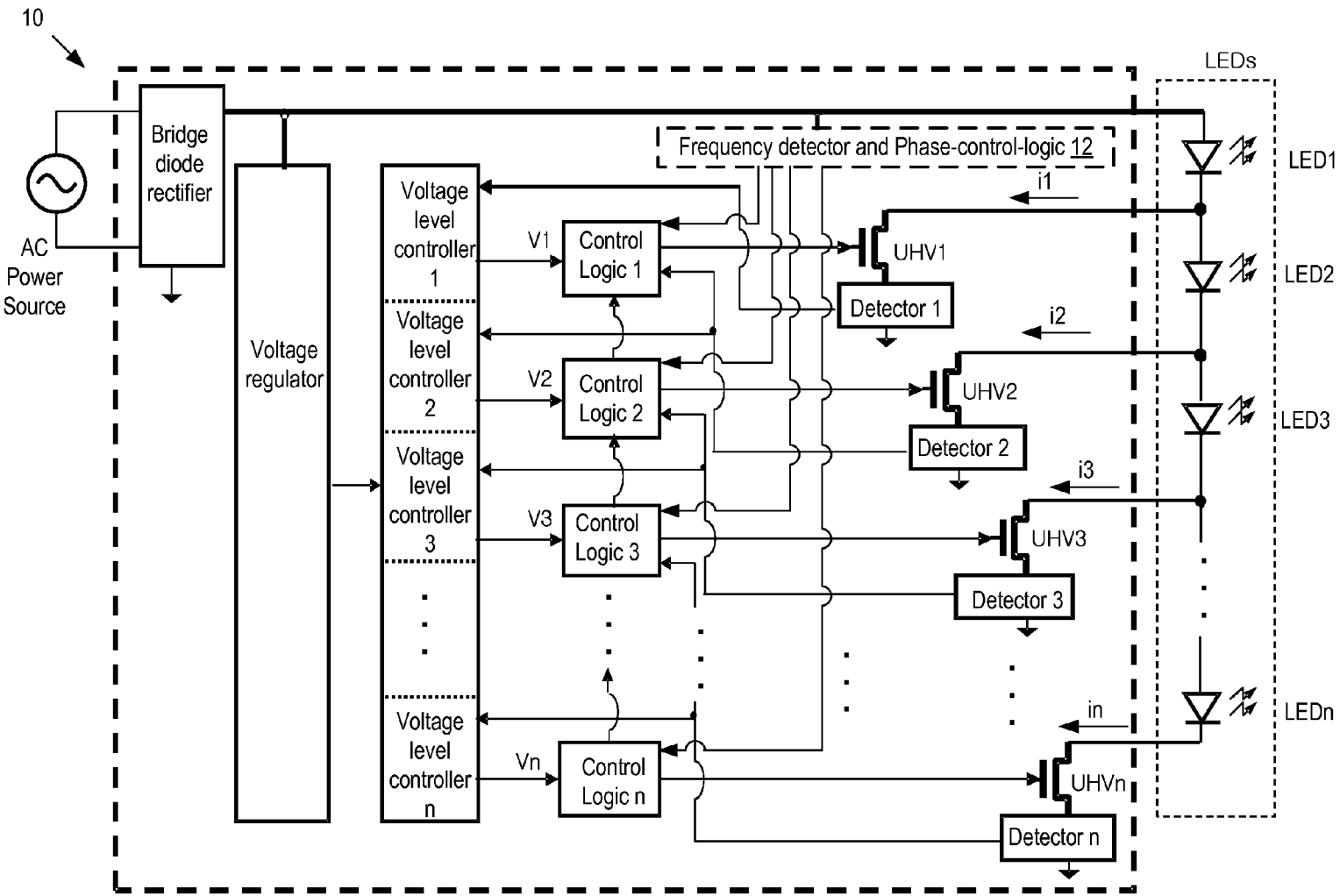
FIG. 1 shows a schematic diagram of an LED driver circuit in accordance with one embodiment of the present invention.

Referring now to FIG. 1, there is shown a schematic diagram of an LED driver circuit (or, shortly driver) 10 in accordance with one embodiment of the present invention. As depicted, the driver 10 is powered by a power source such as an alternative current (AC) power source. The electrical current from the AC power source is rectified by a rectifier circuit. The rectifier circuit can be any suitable rectifier circuit, such as bridge diode rectifier, capable of rectifying the alternating power from the AC power source. The rectified voltage, Vrect, is then applied to a string of light emitting diodes (LEDs). If desirable, the AC power source and the rectifier may be replaced by a direct current (DC) power source. Optionally, a dimmer switch may be installed to adjust the intensity of the light generated by LEDs. Hereinafter, the term "AC power source & dimmer switch" refers to AC power source or AC power source connected to a dimmer switch.

The rectified voltage, Vrect, from the voltage rectifier is converted into a DC voltage by the voltage regulator. Then, the voltage regulator provides the DC voltage to each of the voltage level controllers. Subsequently, each voltage level controller, say voltage level controller 1, outputs a DC voltage, say V1, where V1 may be processed by the control logic 1 prior to being input to the gate of the transistor UHV1. Detailed description of the control logics is given in conjunction with FIG. 6.

The LEDs as used herein is the general term for many different kinds of light emitting diodes, such as traditional LED, super-bright LED, high brightness LED, organic LED, etc. The drivers of the present invention are applicable to all kinds of LED.

As depicted in FIG. 1, a string of LEDs is electrically connected to the power source and divided into n groups, where n is an integer number. It should be apparent to those of ordinary skill in the art that the string of LEDs may be divided into any suitable number of groups. The LEDs in each group may be a combination of the same or different kind, such as different color. They can be connected in serial or parallel or a mixture of both. Also, one or more resistances may be included in each group.

A separate current regulating circuit (or, shortly regulating circuit) is connected to the downstream end of each LED group, where the current regulating circuit collectively refers to a group of elements for regulating the current flow, say i1, and includes one or more transistors (say, UHV1), a detector (say, detector 1), a control logic (say, control logic 1), and a voltage level controller (say, voltage level controller 1). Hereinafter, the term transistor refers to an N-Channel MOSFET, a P-Channel MOSFET, an NPN-bipolar transistor, a PNP-bipolar transistor, an Insulated gate Bipolar Transistor (IGBT), analog switch, or a relay.

As discussed above, each current regulating circuit is electrically connected to the downstream end of the corresponding LED group at one end. The driver 10 can turn on/off each group of LEDs successively using the corresponding current regulating circuit. For example, as Vrect increases from the ground level, the current flows only through the first LED group, LED1, i.e., only the current i1 flows. The detector 1 detects either the current i1 (or voltage drop across a resistor inside detector 1 and sends an output signal to the voltage level controller 1. As Vrect further increases, the output signal from the detector 1 changes, and as a consequence, the output signal V1 of the voltage level controller 1 changes. As V1 changes, the gate voltage of UHV1 also changes so as to regulate the level of current flow i1.

As Vrect still further increases enough to turn on both the first and second LED groups, LED1 and LED2 (or Group 1 and Group 2), the current i2 starts flowing through the second current regulating circuit. Also, the detector 2 sends a signal to both the control logic 1 and the voltage level controller 2. When the current i2 reaches a certain level, the signal from the detector 2 reaches a level where the voltage level of the output signal from the control logic 1 decreases to the ground level. As this ground voltage is applied to the gate of UHV1, the current i1 is completely cut off.

The same analogy applies to other current regulating circuits corresponding to Groups 2-*n*. For example, the current i2 is controlled by the voltage level controller 2, control logic 2, and detector 3. When Vrect is high enough to cause the current i3 to flow through UHV3, the detector 3 send a signal to the control logic 2 so that the gate voltage of the UHV2 is at the ground level, to thereby completely cut off the current i2. When there is no current i2 through the detector 2, the control logic 1 may misunderstand that Vrect is not high enough to turn on the current i2 and that the current i1 should flow. To obviate this misunderstanding, the control logic 2 may receive a signal from the control logic 3, as shown in FIG. 1, and send an output signal to the control logic 1 so that the control logic 1 would not turn on the current i1 when the current i3 flows through UHV3. When the source voltage (or the rectified voltage Vrect) reaches its peak and Vrect starts descending, the above process reverses so that the first current regulating circuit turns back on last.

Optionally, the driver 10 may include a frequency-detector and phase-control-logic 12 (or, shortly, phase controller or phase-control-logic). The detailed description of the frequency-detector and phase-control-logic 12 is given in conjunction with FIG. 8A-10C.

Figure 2:
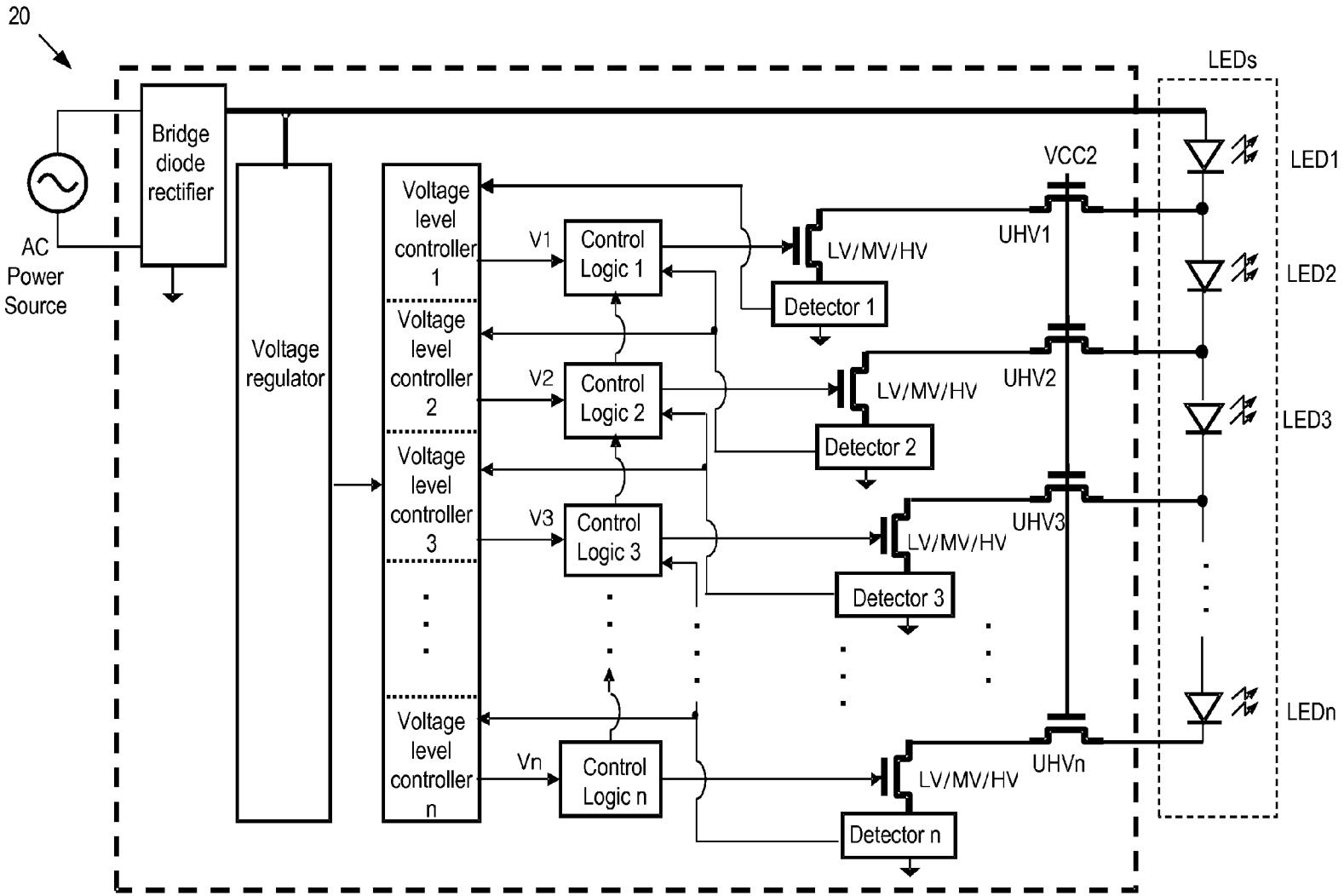
FIG. 2 shows a schematic diagram of an LED driver circuit in accordance with another embodiment of the present invention.

FIG. 2 shows a schematic diagram of an LED driver circuit 20 in accordance with another embodiment of the present invention. As depicted, the driver 20 is similar to the driver 10 in FIG. 1, with the differences that each current regulating circuit includes two transistors UHV and LV/MV/HV that are arranged in series to form a cascode structure. (For simplicity, a frequency-detector and phase-control-logic is not shown in FIGS. 2-5, even though it can be implemented in the drivers of FIGS. 2-5 in the same manner as in FIG. 1.) The cascode structure, which is implemented as a current sink, has various advantages compared to a single transistor current sink. First, it has enhanced current driving capability. When operating in its saturation region, which is desired for a current sink, the current driving capability (Idrv) of an LV/MV/HV NMOS is far superior to an UHV NMOS. For example, Idrv of a typical LV NMOS is 500 μA/μm whereas that of a typical UHV NMOS is 10~20 μA/μm. Thus, to regulate the same amount of current flow, the required projection area of an UHV NMOS on the chip is at least 20 times as large as that of an LV NMOS. Also, a typical UHV NMOS has the minimum channel length of 20 μm, while a typical LV NMOS has the minimum channel length of 0.5 μm. However, a typical LV NMOS requires a shielding mechanism that offers protection from high voltages. In the cascode structure, the first transistor, preferably UHV NMOS, operates as a shielding transistor, while the second transistor, preferably LV/MV/HV NMOS, operates as a current regulator, providing enhanced current driving capability. The shielding transistor is not operating in saturation region as would be in the case where a single UHV NMOS is used as the current sink and operated in the linear region. As such, the current driving capability Idrv is not the determinative design factor; rather the resistance of the shielding transistor, Rdson, is the important factor in designing the UHV NMOS of the cascode.

Second, due to the series configuration of the cascode structure, the required voltage (a.k.a. voltage compliance or voltage headroom) of the cascode structure can be higher than a single UHV NMOS configuration. For an LED driver case, however, the power loss due to the required voltage is much less than the power loss due to the LED driving voltage. For example, in an AC-driven LED driver case, the LED driving voltage (voltage on the LED anode) ranges 100 Vmrs~250 Vrms. Assume the required voltage of a single UHV NMOS is 2V whereas that of a cascode structure is 5V. In this case, the efficiencies are 98~99% and 95~98%, respectively. Of course, Rdson can be reduced so that the required voltage of the cascode structure can be about the same as that of a single UHV NMOS. The point is that the additional power consumed by the cascode structure is a minor disadvantage. If efficiency is a crucial design factor, the cascode structure can be designed in a current mirror configuration whereas a current mirror configuration using two UHV NMOS transistors is not practically feasible due to their large area on the chip.

Third, turning on/off the current sink is easier in the cascode structure since the UHV MOS and LV/MV/HV NMOS are controlled separately. In a single UHV NMOS current sink, both current regulation and on/off action have to be done by controlling the gate of the UHV NMOS, which has the characteristics of a large capacitor. In contrast, in the cascode structure, the current regulation can be done by controlling the LV/MV/HV NMOS and on/off action can be done by controlling the UHV NMOS that requires only logic operation applied on the gate.

Fourth, the speed of turning on/off is controlled more smoothly in the cascode structure than a single UHV NMOS configuration. In a single UHV NMOS configuration, the linear control of current cannot be easily achieved by controlling the gate voltage since the current is a square function of the gate voltage. By contrast, in a cascode structure, when the gate of the LV/MV/HV NMOS is controlled, the current control (slewing) becomes smoother since it is operating as a resistor that is an inverse function of the gate voltage.

Fifth, the cascode structure provides better noise immunity. Noise from the power supply can propagate through the LEDs and subsequently can be coupled to the current regulating circuit. More specifically, the noise is introduced into the feedback loop of the current regulating circuit. In a single UHV NMOS configuration, this noise is directly coupled to this loop, whereas, in a cascode structure, the noise is attenuated by the ratio of Rdson of the UHV NMOS to the effective resistance of the LV/MV/HV NMOS.

Sixth, the noise generated by a cascode structure is lower than a single UHV NMOS configuration. In the cascode structure, the current control is mainly performed by the regulating transistor, while, in a single UHV NMOS configuration, the current control is performed by the UHV NMOS. Since the gate capacitance of the LV/MV/HV NMOS is lower than the UHV NMOS, the noise generated by the cascode structure is lower than a single UHV NMOS configuration.

It is noted that the shielding transistors UHV1-UHVn may be identical or different from each other. Likewise, the regulating transistors LV/MV/HV may be identical or different from each other. The specifications of the shielding and regulating transistors may be selected to meet the designer's objectives.

Figure 3:
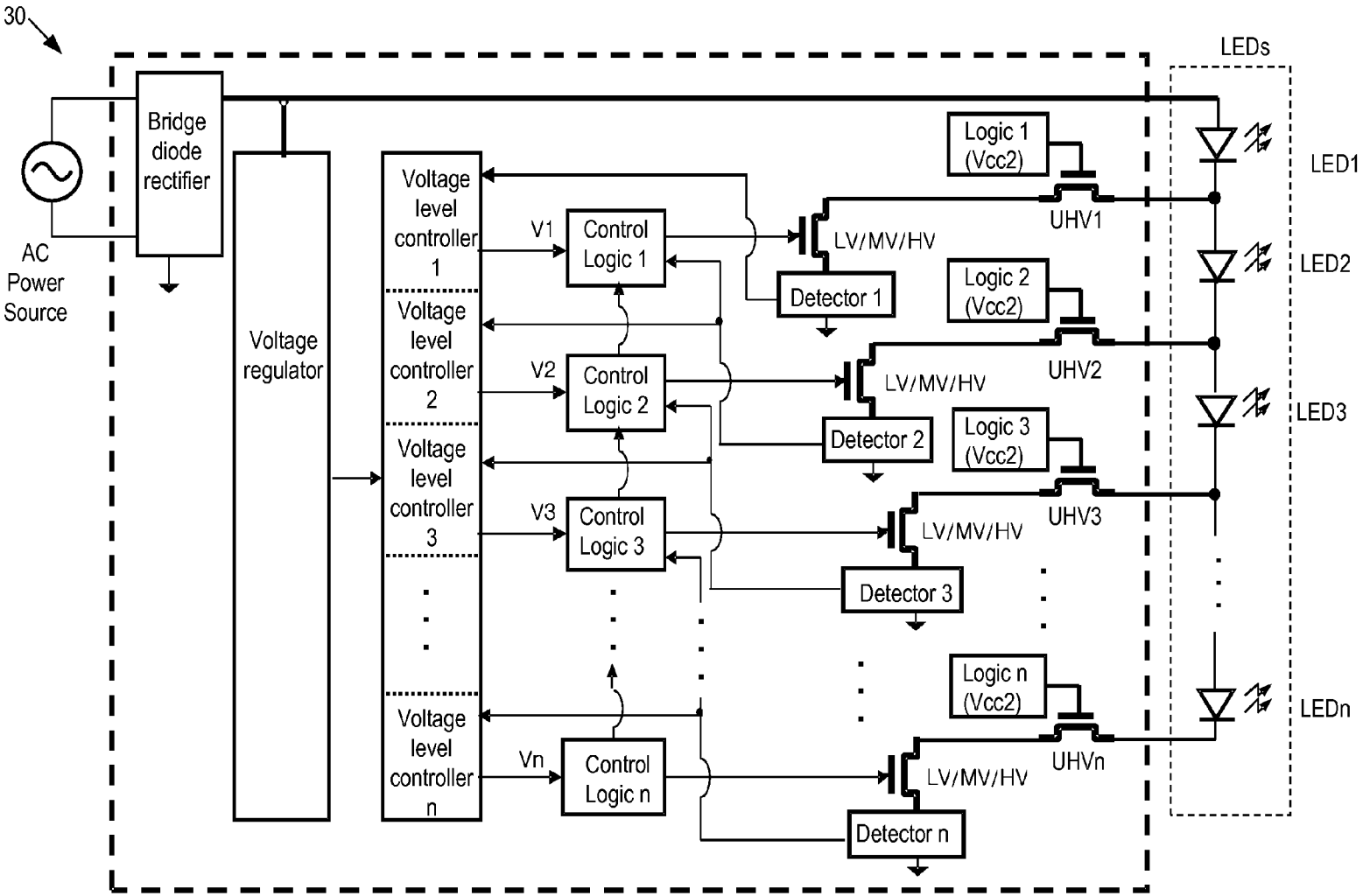
FIG. 3 shows a schematic diagram of an LED driver circuit in accordance with another embodiment of the present invention.

FIG. 3 shows a schematic diagram of an LED driver circuit 30 in accordance with another embodiment of the present invention. As depicted, the driver 30 is similar to the driver 20 in FIG. 2, with the differences that the gate voltage of each shielding transistor, say UHV1, is supplied by a circuit logic, say logic 1. The logic 1-logic n may be identical to each other, or may be different from each other so that the shielding transistors UHV1-UHVn may be operated at different gate voltage. For instance, the gate voltage from logic 1 may be lowest while the gate voltage from logic n may be highest.

Figure 4:
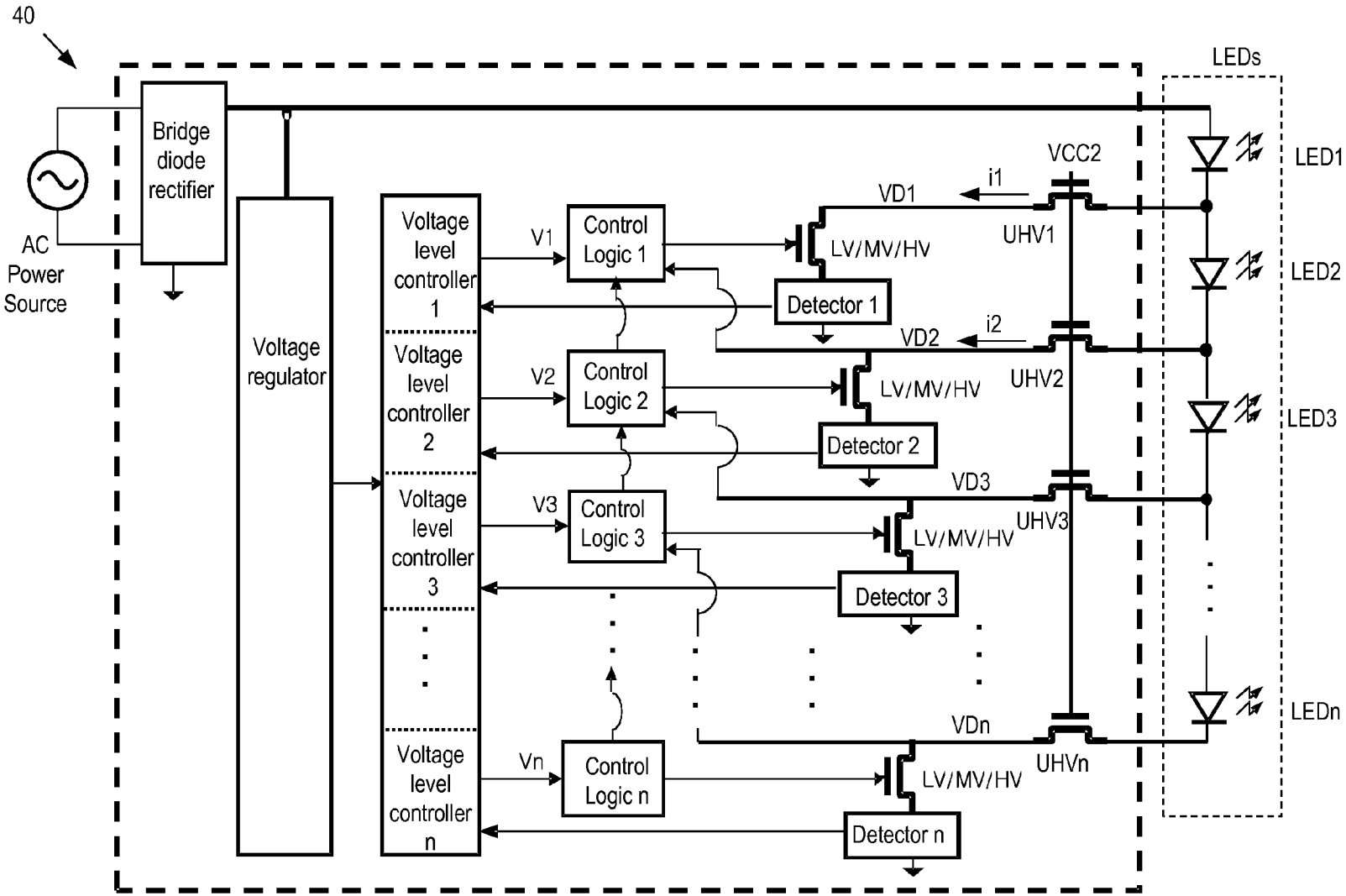
FIG. 4 shows a schematic diagram of an LED driver circuit in accordance with another embodiment of the present invention.

FIG. 4 shows a schematic diagram of an LED driver circuit 40 in accordance with another embodiment of the present invention. As depicted, the driver 40 is similar to the driver 20 in FIG. 2, with the difference that the drain voltage of a regulating transistor of the cascode (or, equivalently, the source voltage of a shielding transistor) is input to the control logic of the current regulating circuit that corresponds to LED upstream of the regulating transistor. For example, the source voltage VD2 of the shielding transistor UHV2 is input to the control logic 1 which corresponds to LED1. During operation, as Vrect increases, the current i2 increases, and the source voltage VD2 of the shielding transistor UHV2 also increases. When the source voltage VD2 reaches a preset level, the output voltage of the control logic 1 is set to ground so that the current i1 is cut off, causing the same current to flow through both LED1 and LED2. As the current i1 is redirected to LED2, LED2 generates more light, thereby increasing the total efficiency of LEDs.

Figure 5:
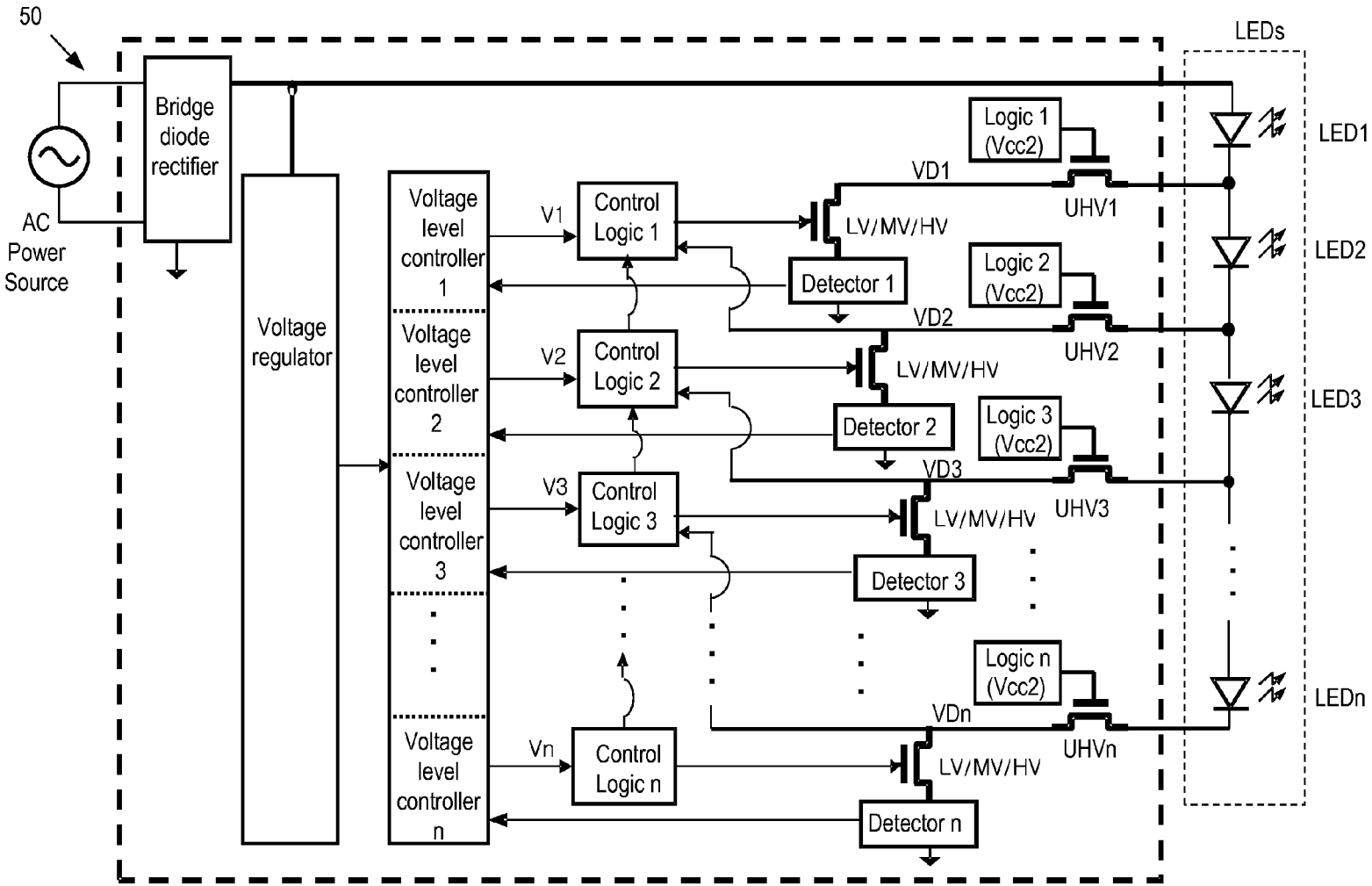
FIG. 5 shows a schematic diagram of an LED driver circuit in accordance with another embodiment of the present invention.

FIG. 5 shows a schematic diagram of an LED driver circuit 50 in accordance with another embodiment of the present invention. As depicted, the driver 50 is similar to the driver 40 in FIG. 4, with the differences that the gate voltage Vcc2 of each shielding transistor, say UHV1, is supplied by a circuit logic, say logic 1. Since the operation of the driver 50 is similar to that of the driver 40, detailed description of the operation is not repeated.

Figure 6:
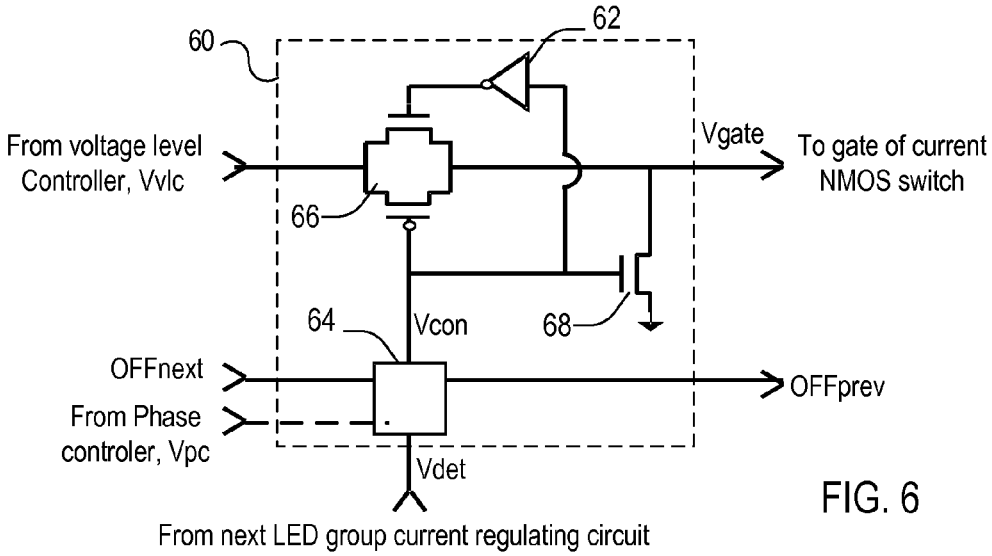
FIG. 6 shows a schematic diagram of a control logic of the type that might be used in the drivers of FIGS. 1-5 in accordance with another embodiment of the present invention.

FIG. 6 shows a schematic diagram of a control logic 60 that might be used in the drivers 10, 20, 30, 40, and 50 in accordance with another embodiment of the present invention. As depicted, the control logic 60 includes: a transistor 68, preferably an NMOS; an inverter 62; a passgate 66, preferably a combination of an NMOS and a PMOS; and a voltage level detector 64.

The output, Vvlc, from a voltage level controller in FIGS. 1-5 is input to the passgate 66, while the output from the passgate 66 is connected to the gate of a transistor, such as UHV2 in FIG. 1, or to the gate of a regulating transistor, such as LV/MV/HV in FIGS. 2-5, to control the current flow through the LED2, for example. For the purpose of illustration, it is assumed that the control logic 60 in FIG. 6 corresponds to the control logic 2 in FIG. 1. The voltage level detector 64 receives an input signal "OFFnext" from the control logic 3. When the current i3 flows through UHV3 and the current i2 is cut off, the control logic 2 sends a signal "OFFprev" to the control logic 1 so that the control logic 1 continues cutting off the current i1. The voltage level detector 64 also receives a signal ("Vdet") from the detector 3, and cuts off the current i2 when Vrect is high enough to cause the current i3 to reach a preset level.

It is noted that the voltage level detector 64 may optionally receive a signal, Vpc, from the frequency-detector and phase-control-logic 12. (The frequency-detector and phase-control-logic 12 is discussed in conjunction with FIGS. 8A-10C.) Using the input signals, Vdet, OFFnext, and optionally Vpc, the voltage level detector 64 sends a signal to the passgate 66 and the transistor 68, to thereby control the level of output voltage, Vgate, from the control logic 60 in FIG. 6. (As discussed above, the output signal Vgate is input to the gate of UHV or LV/MV/HV.) More specifically, when Vdet is low, the output voltage, Vcon, of the voltage level detector 64 is low and Vvlc is directly transferred to Vgate. As Vdet increases, Vcon gradually decreases. When Vdet reaches a preset level, i.e., Vcon increases to a certain level, the passgate 66, inverter 62, and transistor 68 operate to tie the output of the passgate 66 to the ground level. As a consequence, Vgate is also at the ground level, causing the current i2 to be cut off. Also, when the current i3 flows, the OFFnext signal is active so that the control logic 2, more specifically, the voltage level detector 64 of the control logic 2, sends a signal, OFFprev, to the control logic 1 so that the control logic 1 continues cutting off the current i1.

Figure 7A:
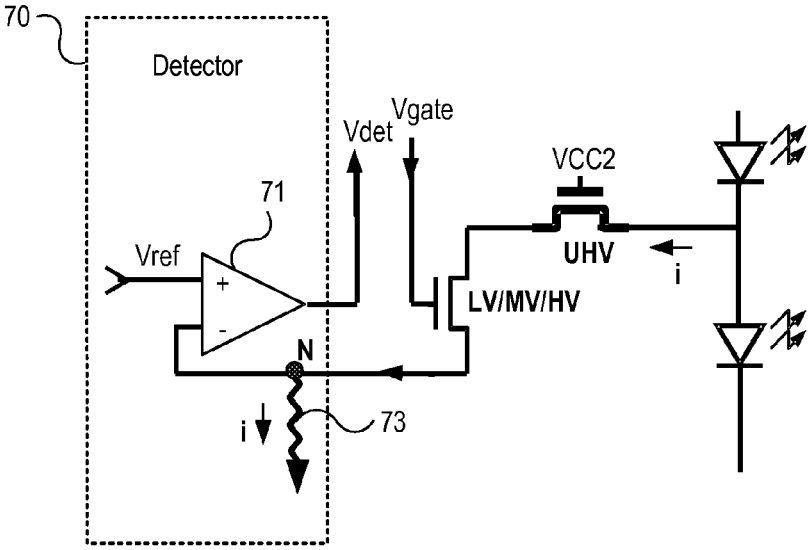
FIG. 7A shows a schematic diagram of a detector of the type that might be used in the drivers of FIGS. 1-5 in accordance with another embodiment of the present invention.

FIG. 7A shows a schematic diagram of a detector 70 that might be used in the drivers 10, 20, 30, 40, and 50 in accordance with another embodiment of the present invention. As depicted, the detector 70 includes an amplifier 71 and a resistor 73. The amplifier 71, which is preferably an operational amplifier, compares the reference voltage, Vref, with the voltage at the node n, and sends the output signal, Vdet, according to the comparison.

Figure 7B:
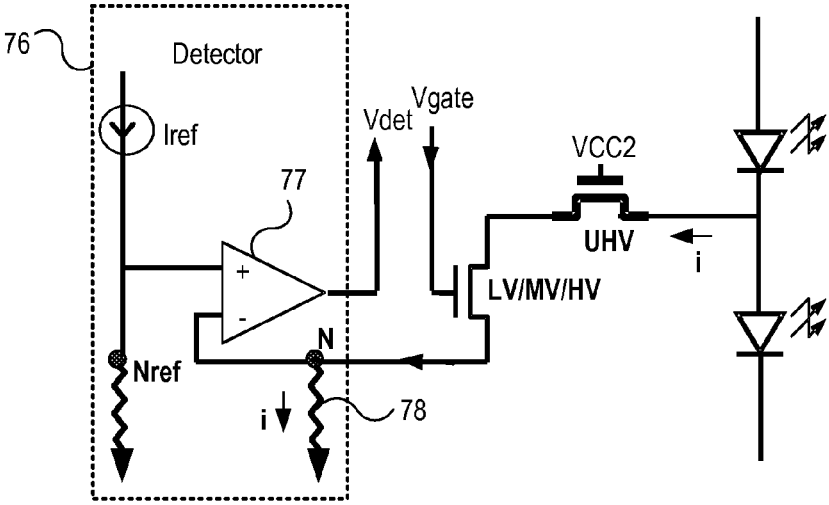
FIG. 7B shows a schematic diagram of a detector of the type that might be used in the drivers of FIGS. 1-5 in accordance with another embodiment of the present invention.

FIG. 7B shows a schematic diagram of a detector 76 that might be used in the drivers 10, 20, 30, 40, and 50 in accordance with another embodiment of the present invention. The detector 76 is similar to the detector 70, with the difference that the reference voltage of the amplifier 77 corresponds to the voltage at the node Nref.

Figure 8A:
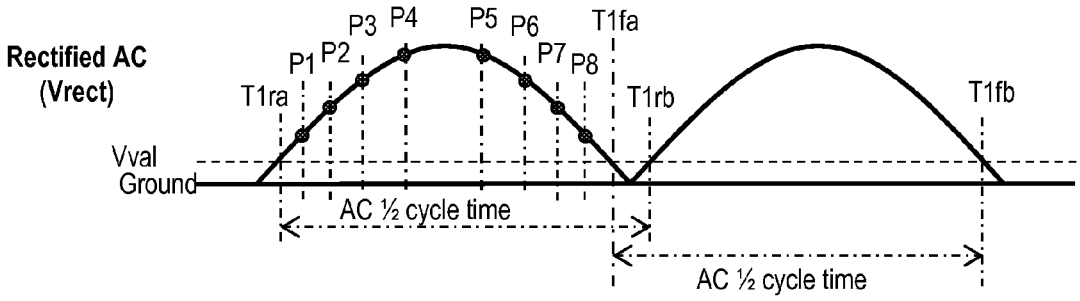
FIGS. 8A-8C show various waveforms of a rectified voltage that might be input to the LEDs of FIGS. 1-5.

As depicted in FIG. 1, the phase-control-logic 12 sends signals to the control logic 1-control logic n. More specifically, the voltage level detector 66 of each control logic receives a signal from the phase-control-logic 12. The operation of the phase-control-logic 12 includes measuring the AC ½ cycle time, where the AC ½ cycle time refers to half the cycle period of AC signal. FIG. 8A shows the waveform of a rectified voltage input to the driver 10 as a function of time, where the AC ½ cycle time is the time interval between T1*ra* and T1*rb* or between T1*fa* and T1*fb*. FIG. 8D shows a schematic diagram of the phase-control-logic 12 of FIG. 1. As depicted in FIG. 8D, the detector 83 monitors the voltage level of Vrect and sends a signal, enable 1, when Vrect rises to a preset level, such as Vval. For instance, the detector 83 sends the first enable signal at T1*ra*. Then, the clock counter 84 starts counting the clock signals received from the oscillator 86. As Vrect rises to the Vval at T1*rb*, the detector 83 sends the second enable signal to the clock counter 84 and the clock counter 84 stops counting the clock signals. Subsequently, the measured counter value is transferred (or, loaded) to the frequency selector 85 to determine the frequency of AC input (or, Vrect). Upon transferring the measured counter value, the clock counter 84 resets the counter value and starts counting again to keep monitoring of rectified AC voltage frequency.

Based on the determined frequency, the frequency selector 85 chooses preset time intervals for the switch tabs (or, shortly, tabs). The driver 10 (shown in FIG. 1) include n tabs 81 that correspond to the input ports of the voltage level detectors 64 of the control logic 1-control logic n, and the frequency selector 85 assigns a preset time interval to each tab, where the preset time interval refers to the time interval between a reference point (such as T1*ra*) and the time when a signal is to be sent to the corresponding tab (such as P1 in FIG. 8A).

The detector 87 monitors the level of descending (or rising) Vrect and sends an enable signal, enable 2, when Vrect falls (or rises) to a predetermined voltage level, such as Vval. Then, the clock counter 88 starts counting the clock signal generated by the oscillator 86. Subsequently, the tab selector 89 receives the count from the clock counter 88. Then, the tab selector 89 compares the count received from the clock counter 88 to the preset time interval received from the frequency selector 85, and sends a switch enabling signal to the corresponding one of the tabs 81 when the count of the clock counter 88 matches the preset time interval. Upon receiving the switch enabling signal from tab selector 89, the corresponding tab, such as the control logic 1, turns on/off the transistor UHV1.

A digital locked loop or a phase locked loop may be used in place of the clock counter 84 (or, clock counter 88). As the DLL, PLL, and clock counter are well known in the art, the detailed description is not given in the present document.

The driver 10 can turn on/off each group of LEDs successively according to the signals received from the phase-control-logic 12. For example, the phase-control-logic 12 sends a signal to the control logic 1 to turn on the transistor UHV1, while the other transistors UHV2-UHVn are turned off. As will be discussed on conjunction with FIGS. 10A-10C, the phase-control-logic 12 may send output signals to the control logic 1-control logic n to control the transistors UHV1-UHVn in various time sequences.

For simplicity and for the purpose of illustration, it is assumed that the tabs 81 include only 4 tabs, i.e., there are only 4 LED groups in the following discussion. Since there are four control logics, eight preset time intervals (i.e., the time intervals between T1*ra* and P1, T1*ra* and P2, T1*ra* and P3, T1*ra* and P4, T1*ra* and P5, T1*ra* and P6, T1*ra* and P7, and T1*ra* and P8, as shown in FIG. 8A) are assigned to the corresponding control logic by the frequency selector 85. Since each of the preset time intervals corresponds to a fixed phase point of the input voltage waveform, each of the preset time intervals also refers to a phase difference between the reference phase at T1*ra* and the phase at the corresponding point, such as P1. As such, the terms "preset time interval" and "preset phase difference" are used interchangeably.

As discussed above, the detector 83 may send the enable signal when Vrect rises or falls to Vval. For example, the detector 83 may send the enable signal at T1*fa* and T1*fb* (or, T1*ra* and T1*rb*) so that the clock counter 84 can count the clock signals during one AC ½ cycle time. Likewise, the detector 87 may send the enable signal when Vrect rises or falls to Vval. It is also noted that the detectors 83 and 87 may send enable signals at different preset voltage levels.

Figure 8B:
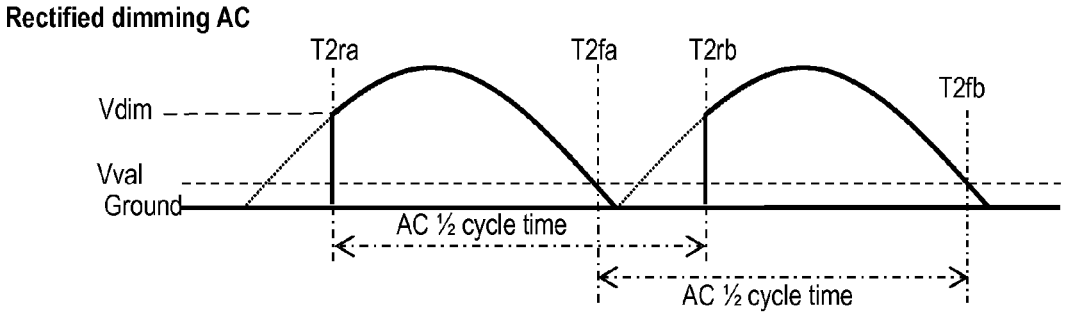
Figure 8C:
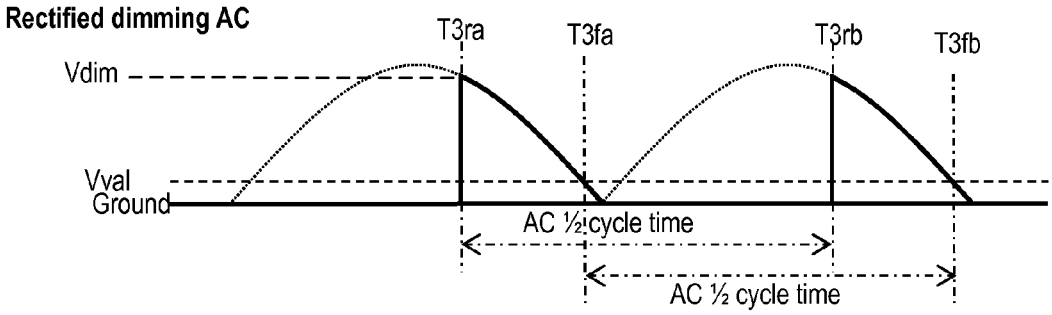
Figure 8D:
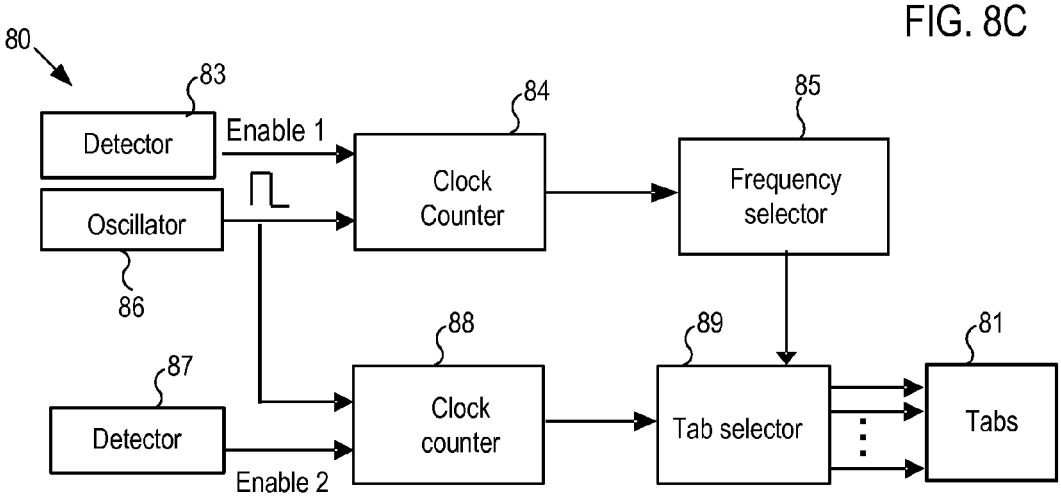
FIG. 8D shows a schematic diagram of a frequency-detector and phase-control-logic of the type that might be included in the driver of FIG. 1.

FIGS. 8B and 8C show various waveforms of the rectified voltage input to the driver 10 of FIG. 1, where the AC input voltage is processed by dimmer switches. As depicted, the dimmer switch maintains the AC input voltage to the ground level until the AC input voltage rises to Vdim (FIG. 8B) or falls to Vdim (FIG. 8C). The phase-control-logic 12 may measure AC ½ cycle time by counting the clock signal between T2*ra* and T2*rb* or between T2*fa* and T2*fb*. More specifically, the detectors 83 and 87 may send enable signals at one of the points in time, T2*ra*, T2*rb*, T2*fa*, and T2*fb*. The same analogy applies to Vrect in FIG. 8C, i.e., the detectors 83 and 87 may send enable signals at one of the points in time, T3*ra*, T3*rb*, T3*fa*, and T3*fb*.

The phase-control-logic 12 controls the currents i1-i4 based on the frequency and phase of the AC input voltage waveform. This approach is useful when the noise level of the AC power source is high and/or it is preferable to make the current waveform smoothly follow the AC input voltage waveform. As shown in FIG. 1, the current i1 is controlled by a feedback control system formed by the detector 1, control logic 1, voltage level controller 1, and UHV1. If the current i1 is controlled by the feedback control mechanism only, the current i1 will fluctuate significantly when the noise level of Vrect is high since the feedback control mechanism relies on the level of Vrect. The fluctuation of current flows i1-i4 may result in the luminance flicker that can be perceived by human eyes.

Figure 9A:
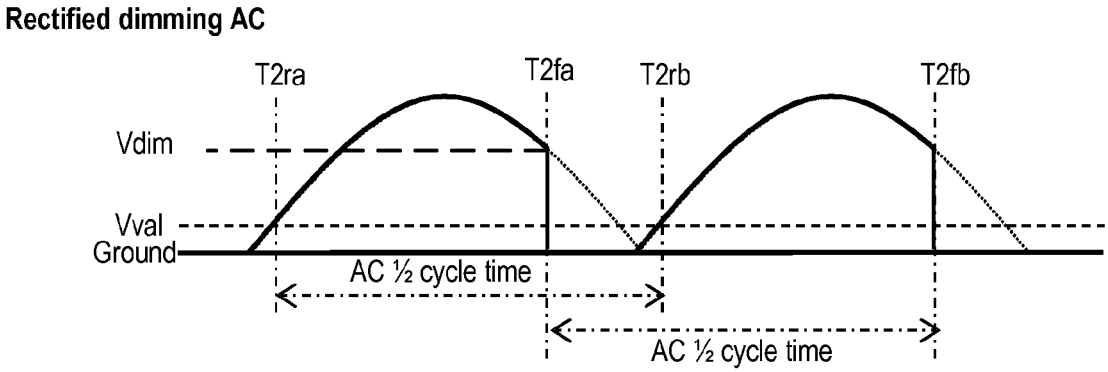
FIGS. 9A-9B show various waveforms of a rectified voltage that might be input to the LEDs of FIGS. 1-5.
Figure 9B:
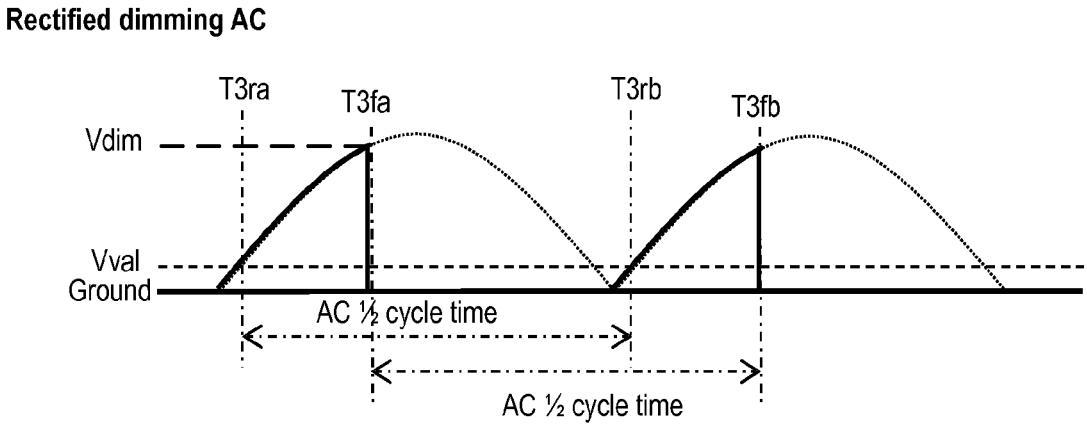

FIGS. 9A and 9B show two waveforms of the rectified voltage that might be input to the driver 10 of FIG. 1. Unlike the dimmers used to generate the waveforms in FIGS. 8B and 8C, the dimmers used to generate the waveforms in FIGS. 9A and 9B cut off the rear portion of each cycle, i.e., Vrect is maintained at the ground level after Vrect rises/falls to Vdim. As the phase-control-logic 12 measures the frequency and phase in the same manner as described in conjunction with FIGS. 8B and 8C, the detailed description of the operational procedures of the phase-control-logic 12 is not repeated for brevity. Further information of the operation of the phase-control-logic 12 can be found in the previously referenced U.S. patent application Ser. No. 13/244,900.

Figure 10A:
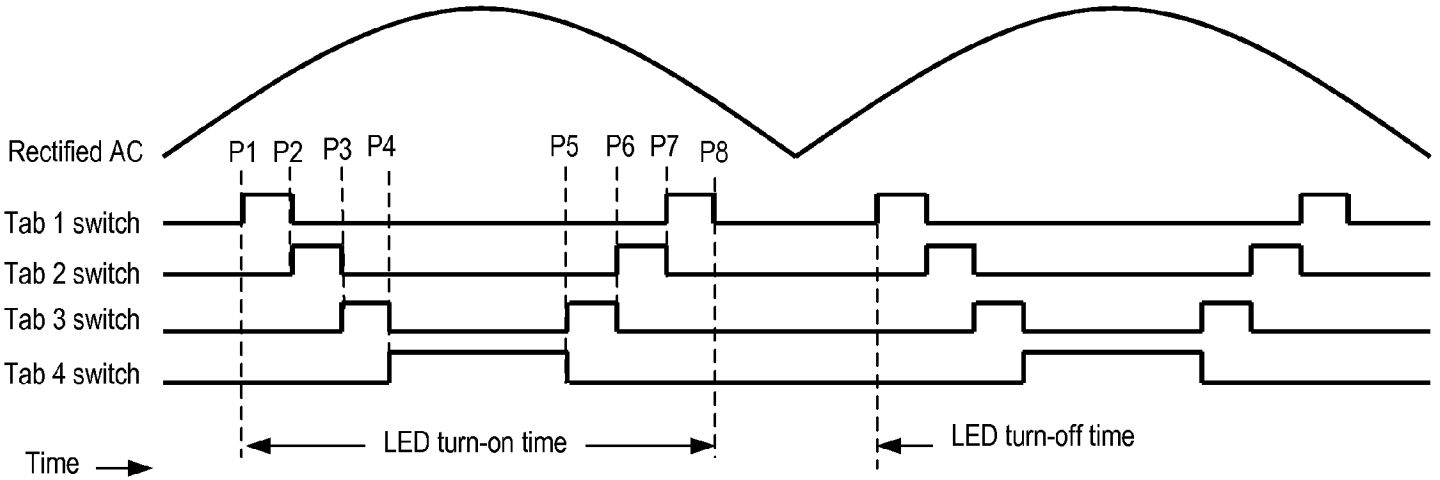
FIGS. 10A-10*c* show output signals of the frequency-detector and phase-control-logic of FIG. 8D.

FIG. 10A shows output signals of the phase-control-logic 12 of FIG. 1, where the four tab switches (or, shortly tabs) correspond to the four control logics, control logic 1-control logic 4. More specifically, each tab switch signal, say tab 1 switch signal, is sent to the corresponding control logic, say control logic 1, so that the control logic turns on/off the corresponding transistor, say UHV1. As depicted in FIG. 10A, the hat-shaped portions of each tab switch signal waveform represent the time intervals when the corresponding control logic is turned on (i.e., the output signal of the control logic is above the ground level, or, stated differently, the tab switch signal is in the active state.) As such, the signals sent to the control logics are sequenced in time so that only one of the transistors UHV1-UHV4 is turned on at each point in time. More specifically, turn-on and turn-off signals are sent by the phase-control-logic 12 to control logic 1 at P1 and P2, respectively. (Here, P1-P8 of FIG. 10A correspond to P1-P8 of FIG. 8A, respectively.) Likewise, control logic 2, control logic 3, and control logic 4 are turned on/off by signals at P2/P3, P3/P4, and P4/P5, respectively. When the Vrect decreases from its peak, the control logic 3, control logic 2, and control logic 1 are turned on/off by signals sent at P5/P6, P6/P7, and P7/P8, respectively. As such, only one control logic is turned on (i.e., in the active state) at each point in time.

Figure 10B:
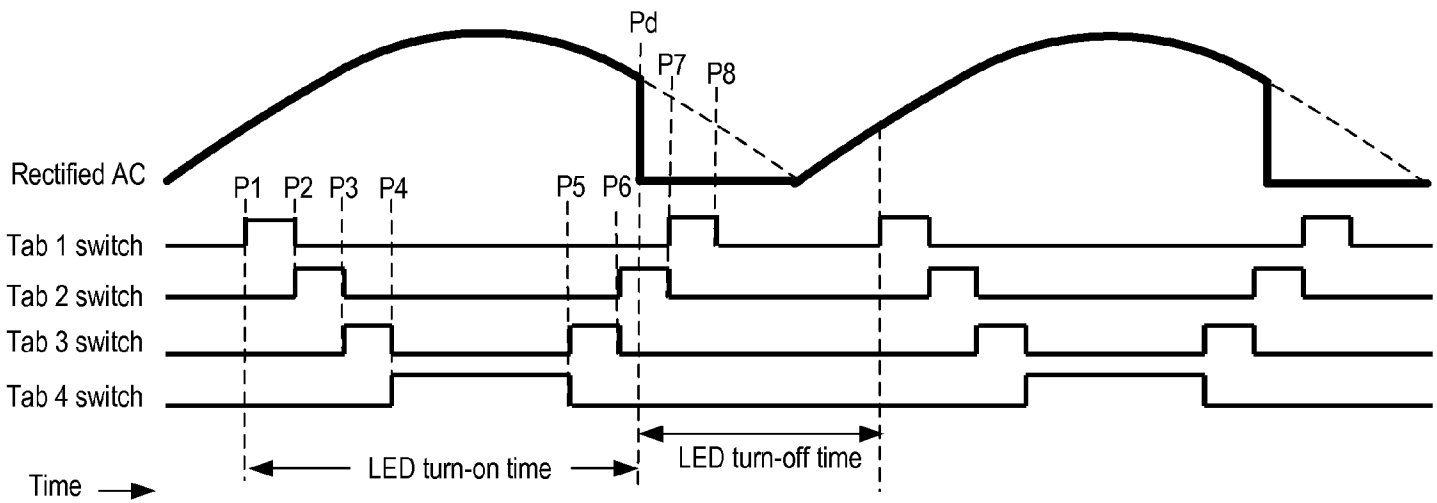
Figure 10C:
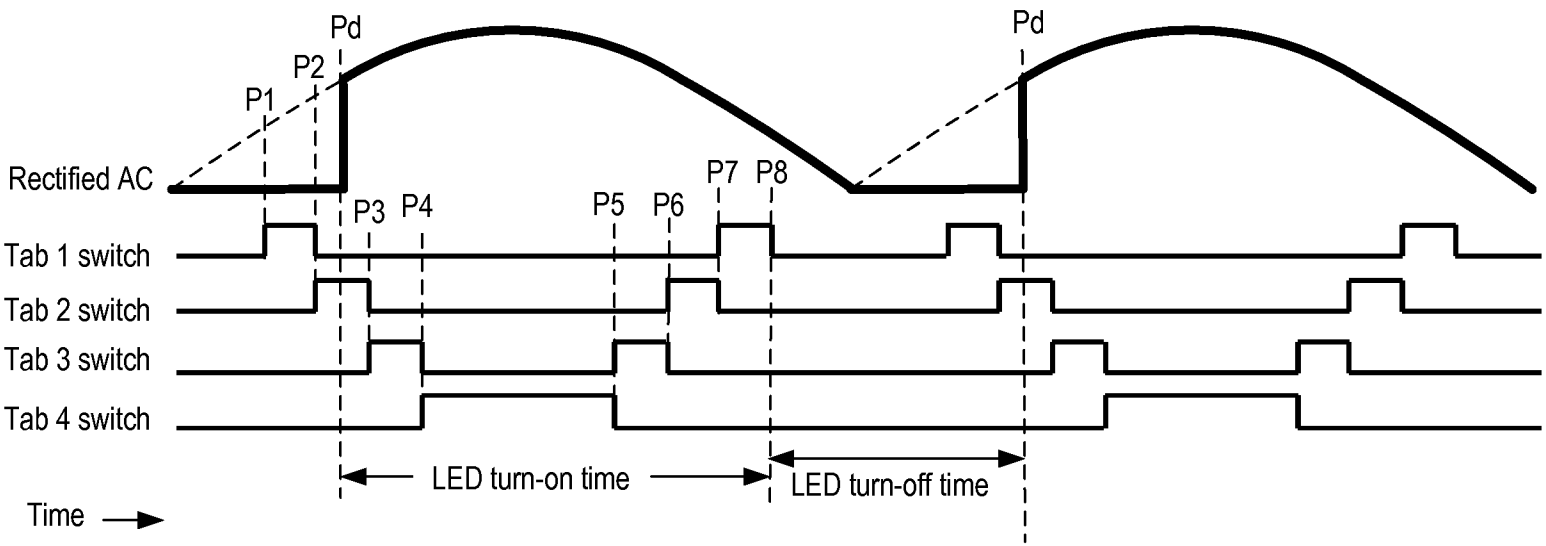

FIG. 10B shows output signals of the phase-control-logic 12 of FIG. 1 according to another embodiment. As depicted, the waveform of Vrect is similar to Vrect in FIG. 9A, i.e., a dimmer is used to generate the waveform in FIG. 10B. The timing sequences in FIG. 10B are similar to those in FIG. 10A, i.e., only one control logic is turned on at each point in time. It is noted that, in FIG. 10B, Tab 2 switch, such as control logic 2, may be in the active state at Pd. However, as Vrect drops to the ground level at Pd, the current flowing through the second current regulating circuit will also drop to zero at Pd. Also, there will be no current flowing through the LED groups between P7 and P8, even though control logic 1 is in the active state. As such, the total light emitted by the LED groups will be diminished as intended by the dimmer designer.

FIG. 10B shows output signals of the phase-control-logic 12 of FIG. 1 according to another embodiment. As depicted, the waveform of Vrect is similar to Vrect in FIG. 8B, i.e., a dimmer is used to generate the waveform in FIG. 100. The timing sequences in FIG. 100 are similar to those in FIG. 10A, i.e., only one control logic is turned on at each point in time. It is noted that, in FIG. 100, Tab 2 switch, such as control logic 2, is turned on at P2. However, as Vrect rises from the ground level at Pd, the current will begin to flow through the second current regulating circuit at Pd, i.e., the current will not flow between P2 and Pd. Also, there will be no current flowing through the LED groups between P1 and P2, even though control logic 1 is in the active state. As such, the total light emitted by the LED groups will be diminished as intended by the dimmer designer.

As discussed above, the phase-control-logic 12 may be implemented in the drivers of FIGS. 2-5. Also, dimmer switches may be implemented in the drivers of FIGS. 2-5. Thus, the waveforms and sequencing modes shown in FIGS. 9A-10C can be applied to all of the driver circuits described in conjunction with FIGS. 2-5.

In FIG. 1, the phase-control-logic 12 is depicted as a component that is independent from voltage level controllers and control logics. However, it should be apparent to those of ordinary skill in the art that the phase-control-logic 12 may be combined with the voltage level controllers or control logics to form an integral circuit.

It should be understood, of course, that the foregoing relates to exemplary embodiments of the invention and that modifications may be made without departing from the spirit and scope of the invention as set forth in the following claims.

What is claimed is:

1. A driver circuit for driving light emitting diodes (LEDs), comprising:

a string of LEDs divided into n groups, the n groups of LEDs being electrically connected to each other in series, a downstream end of group m−1 being electrically connected to the upstream end of group m, where m is a positive number equal to or less than n; and a plurality of current regulating circuits, each of the current regulating circuits being coupled to a downstream end of a corresponding group and including a cascode having first and second transistors and a detector for measuring a current flowing through the corresponding group.

2. A driver as recited in claim 1, wherein each of the groups includes one or more LEDS and resistors of the same or different kind, color, and value, connected in parallel or in series or combination thereof.

3. A driver as recited in claim 1, wherein the first transistor is an ultra-high-voltage (UHV) transistor and is a N-Channel MOSFET, a P-Channel MOSFET, a NPN bipolar transistor, a PNP bipolar transistor, or an Insulated gate bipolar Transistor (IGBT), and wherein the second transistor is a low-voltage, a medium voltage, or a high voltage transistor and is a N-Channel MOSFET, a P-Channel MOSFET, a NPN bipolar transistor, a PNP bipolar transistor, or an Insulated gate bipolar Transistor (IGBT).

4. A driver as recited in claim 3, further comprising:

a plurality of circuit logics, each of the plurality of circuit logics being adapted to provide a preset voltage, wherein a gate of the second transistor is connected to a corresponding one of the plurality of circuit logics.

5. A driver as recited in claim 3, further comprising:

a circuit logic for providing a preset voltage, wherein the gate of the first transistor of each of the current regulating circuits is connected to the circuit logic.

6. A driver as recited in claim 1, wherein each of the current regulating circuits includes:

a voltage level controller adapted to receive a signal from the detector and send an output signal according to the signal from the detector; and a control logic adapted to receive the output signal from the voltage level controller and send an output signal directly to a gate of the second transistor.

7. A driver as recited in claim 6, wherein the detector corresponding to a downstream group is adapted to detect a current flowing through the downstream group and send a signal to the control logic corresponding to a next upstream group.

8. A driver as recited in claim 6, wherein the control logic corresponding to a downstream group is adapted to receive a signal from the control logic corresponding to a next upstream group.

9. A driver as recited in claim 6, wherein the second transistor has a drain directly connected to a source of the first transistor and wherein the source of the first transistor corresponding to a downstream group is directly connected to the control logic corresponding to a next upstream group.

10. A driver as recited in claim 6, wherein the detector includes an amplifier connected to a reference voltage source for providing a reference voltage thereto.

11. A driver as recited in claim 10, wherein the reference voltage source includes a reference current and a resistor.

12. A driver as recited in claim 6, further comprising:

a phase control logic including:

a detector for monitoring a level of an input voltage applied to the driver and sending an enable signal when the level reaches a preset level;

a frequency selector for determining, based on the enable signal, a frequency of the input voltage applied to the driver and assigning a preset time interval to each of the current regulating circuits; and a selector for selecting a particular one of the current regulating circuits and sending a control signal to the particular current regulating circuit when a passage of time from the enable signal matches the preset time interval.

13. A driver as recited in claim 12, wherein the phase control logic is directly connected to the control logic of each of the current regulating circuits.

14. A method for driving light emitting diodes (LEDs), comprising:

providing a string of LEDs divided into groups, the groups being electrically connected to each other in series;

coupling each of the groups to a ground through a separate current regulating circuit that includes a cascode having first and second transistors;

causing a detector of the separate current regulating circuit to measure a current flowing through a corresponding one of the groups; and controlling the current based on the measured current.

15. A method as recited in claim 14, further comprising:

causing the detector to send a signal commensurate to the measured current to a voltage level controller of the separate current regulating circuit;

causing the voltage level controller to send a signal to a control logic of the separate current regulating circuit; and causing the control logic to send a signal directly to a gate of the second transistor of the separate current regulating circuit.

16. A method as recited in claim 15, further comprising:

causing a detector of a downstream group to send a signal to the control logic of a next group upstream of the downstream group.

17. A method as recited in claim 15, further comprising:

connecting a drain of the second transistor of a downstream group to the control logic of a next group upstream of the downstream group.

18. A method of recited in claim 15, further comprising;

providing a plurality of circuit logics, each of the plurality of circuit logics being adapted to provide a preset voltage; and connecting a gate of the second transistor to a corresponding one of the plurality of circuit logics.

19. A method of recited in claim 15, further comprising;

providing a circuit logic for supplying a preset voltage; and connecting a gate of the first transistor to the circuit logic.

20. A method as recited in claim 15, further comprising:

providing a dimmer switch; and causing the dimmer switch to process a voltage waveform applied to the string of the LEDs to thereby adjust a luminance of the string of the LEDs.

21. A method as recited in claim 15, further comprising:

connecting a phase control logic directly to the control logic of each of the groups; and causing the phase control logic to send a signal to the control logic when a difference between a phase of a voltage waveform applied to the groups and a reference phase matches a preset phase difference.

22. A driver circuit for driving light emitting diodes (LEDs), comprising:

a string of LEDs divided into n groups, the n groups of LEDs being electrically connected to each other in series, a downstream end of group m−1 being electrically connected to the upstream end of group m, where m is a positive number equal to or less than n;

a plurality of current regulating circuits, each of the current regulating circuits being coupled to a downstream end of a corresponding group and including a transistor; and a phase control logic including:

a detector for monitoring a level of an input voltage applied to the driver and sending an enable signal when the level reaches a preset level;

a frequency selector for determining, based on the enable signal, a frequency of the input voltage and assigning a preset time interval to each of the current regulating circuits; and a selector for selecting a particular one of the current regulating circuits and sending a control signal to a gate of the particular current regulating circuit when a passage of time from the enable signal matches the preset time interval.

* * * * *